US009722331B2

(12) United States Patent
Joo et al.

(10) Patent No.: US 9,722,331 B2
(45) Date of Patent: Aug. 1, 2017

(54) POWER INLET SOCKET FOR PROVIDING POWER TO ELECTRONIC DEVICE

(71) Applicant: SAMSUNG ELECTRONICS CO., LTD., Suwon-si (KR)

(72) Inventors: Sung-yong Joo, Hwaseong-si (KR); Jin-hyung Lee, Anyang-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/193,298

(22) Filed: Jun. 27, 2016

(65) Prior Publication Data

US 2017/0040744 A1 Feb. 9, 2017

(30) Foreign Application Priority Data

Aug. 6, 2015 (KR) ..... 10-2015-0111095

(51) Int. Cl.

| | |
|---|---|
| ***H01R 9/24*** | (2006.01) |
| ***H01R 13/648*** | (2006.01) |
| ***H01R 24/76*** | (2011.01) |
| *H01R 103/00* | (2006.01) |

(52) U.S. Cl.

CPC ..... *H01R 9/2491* (2013.01); *H01R 13/648* (2013.01); *H01R 24/76* (2013.01); *H01R 2103/00* (2013.01)

(58) Field of Classification Search

CPC ..... H01R 9/2491

See application file for complete search history.

(56) References Cited

U.S. PATENT DOCUMENTS

| | | | | | |
|---|---|---|---|---|---|
| 4,273,408 | A * | 6/1981 | Orr | H01R 9/2491 | 439/709 |
| 5,510,960 | A * | 4/1996 | Rosen | H01R 9/2425 | 361/624 |
| 5,563,761 | A * | 10/1996 | Apa | H01R 13/6666 | 361/111 |
| 5,902,153 | A * | 5/1999 | Weickenmeier | H01R 9/2491 | 439/620.09 |
| 6,008,634 | A * | 12/1999 | Murofushi | G01R 15/202 | 324/117 H |
| 7,544,104 | B2 * | 6/2009 | Fan | H01R 12/52 | 439/65 |
| 8,514,582 | B2 * | 8/2013 | Blake | H01P 5/10 | 361/752 |
| 9,425,542 | B1 * | 8/2016 | Wu | H01R 13/521 | |

(Continued)

*Primary Examiner* — James Harvey

(74) *Attorney, Agent, or Firm* — Sughrue Mion, PLLC

(57) ABSTRACT

A power inlet socket coupled to a power delivering member of an electronic device to supply power from an external power plug to the electronic device includes a socket body comprising a power plug connector connected to the external power plug and a power delivering member connector connected to the power delivering member; three terminal pins, each terminal pin comprises a projecting pin extending from the power plug connector in parallel with one another to correspond to a terminal of the external power plug and a connection terminal exposed to the power delivering member connector; and an insulating barrier provided between at least a pair of connection terminals of the three terminal pins to cut off an electric current flowing among the connection terminals. Thus, the insulating distance of power inlet socket is improved.

14 Claims, 16 Drawing Sheets

(56) References Cited

U.S. PATENT DOCUMENTS

| | | | | |
|---|---|---|---|---|
| 2004/0253859 | A1* | 12/2004 | Hirata | H01R 13/6485 439/181 |
| 2009/0130919 | A1* | 5/2009 | Wu | H01R 9/2458 439/709 |
| 2010/0081340 | A1* | 4/2010 | Fogg | H01R 13/514 439/701 |
| 2013/0328402 | A1 | 12/2013 | Noguchi | |
| 2014/0304961 | A1 | 10/2014 | Cherry et al. | |
| 2014/0368051 | A1 | 12/2014 | Kidd | |
| 2015/0061644 | A1 | 3/2015 | Parks et al. | |
| 2015/0084503 | A1 | 3/2015 | Liu et al. | |
| 2015/0108900 | A1 | 4/2015 | Maa et al. | |
| 2017/0040744 | A1* | 2/2017 | Joo | H01R 13/648 |

* cited by examiner

POWER INLET SOCKET FOR PROVIDING POWER TO ELECTRONIC DEVICE

CROSS-REFERENCE TO RELATED APPLICATION

This application claims priority from Korean Patent Application No. 10-2015-0111095, filed on Aug. 6, 2015, in the Korean Intellectual Property Office, the disclosure of which is incorporated herein by reference in its entirety.

BACKGROUND

Field

Apparatuses and methods consistent with the exemplary embodiments relate to a power inlet socket for providing power to an electronic device, and more particularly to a 3-pin AC power inlet socket with an improved insulating distance among terminals.

Description of the Related Art

An electronic device, such as a television, monitor and laptop computer, etc., includes a power inlet socket for accessing an external power plug to thereby receive power. The power inlet socket is connected to a circuit substrate of a power supply of the electronic device, and delivers power supplied by the power plug to the electronic device. FIG. 1 illustrates an electronic device 101, an external power plug 102 for delivering alternating current (AC) power and a power inlet socket 103, connected to the external power plug 102 and providing AC power to the electronic device 101.

FIG. 2 illustrates a conventional power inlet socket and a power delivering member for delivering power to an electronic device. Referring to FIG. 2, a power inlet socket 103 includes a socket body 104 and three terminal pins 105, 115, 106, 116, 107 and 117. The socket body 104 consists of an insulating material, and power plug connectors 108 and 109 configured to be connected to the power plug 102, and power delivering member connectors 110 and 111 configured to be connected to the power delivering member 112. The power plug connectors 108 and 109 include a top portion 108 of the socket body 104 and a cavity 109 accommodating the power plug connectors 108 and 109. The three terminal pins 105, 115, 106, 116, 107 and 117 are provided to extend in parallel with one another in the cavity 109. The power delivering member connectors 110 and 111 include a bottom portion 111 of the socket body 104 facing the power delivering member 112 and a coupling portion 110 configured to be coupled to the power delivering member 112. The power inlet socket 103 may be fixed to the power delivering member 112 by inserting a coupling means such as a screw to a groove of the coupling portion 110.

The three terminal pins 105, 115, 106, 116, 107 and 117 are lives 105 and 115, neutrals 107 and 117 and grounds 106 and 116, and include projecting pins 105, 106 and 107 connected to a terminal of the power plug 102, and connection terminals 115, 116 and 117 connected to the power delivering member 112, respectively.

If the power inlet socket 103 and the power delivering member 112 are coupled to each other, there exists a space 113 between the bottom portion 111 of the socket body 104 and the power delivering member 112. If an instantaneous high current is supplied to the power inlet socket 103 connected to the power plug 102, through an interior wiring due to lightning, etc., an electric current may flow among the connection terminals 115, 116 and 117 through air in the space 113. If power is an ultrahigh voltage, discharge through the ground does not properly take place, and thus a high current is introduced to the electronic device through the power supplying member, causing damage to other components of the electronic device.

SUMMARY

One or more exemplary embodiments resolve a problem of a malfunction of the electronic device due to an instantaneous high current as described above, a power inlet socket which secures an additional distance between at least one pair of connection terminals of three terminal pins is provided.

According to an aspect of an exemplary embodiment, there is provided a power inlet socket coupled to a power delivering member of an electronic device to supply power from an external power plug to the electronic device, the power inlet sock including: a socket body including a power plug connector connected to the external power plug and a power delivering member connector connected to the power delivering member; three terminal pins, each terminal pin includes a projecting pin extending from the power plug connector in parallel with one another to correspond to a terminal of the external power plug and a connection terminal exposed to the power delivering member connector; and an insulating barrier provided between at least a pair of connection terminals of the three terminal pins to cut off an electric current flowing among the connection terminals.

The insulating barrier may include a cover to cover at least one of the connection terminals.

The cover may be coupled to the power delivering member connector.

The cover may be integrally formed in the power delivering member connector.

The cover may include: a threshold standing with respect to the power delivering member connector; and a top cover covering the connection terminals.

The top cover extends from the threshold and may be integrally formed in the threshold.

The top cover may be coupled to the threshold.

The threshold may be formed with a guide groove, and the top cover may be inserted into the threshold and fixed to the threshold along the guide groove.

The threshold may be coupled to the power delivering member connector.

The threshold may be integrally formed in the power delivering member connector.

The insulating barrier may include a threshold that projects from the power delivering member connector by a predetermined height.

A height of the threshold may be higher than a top portion of at least one of the pair of connection terminals.

The insulating barrier may be provided in a space between the power delivering member connector and the power delivering member of the electronic device.

The insulating barrier may be configured to block a straight path between top portions of the pair of connection terminals.

The power inlet socket may include a projection that projects from the power plug connector and covers a part of the projecting pins of at least one of the three terminal pins to cut off an electric current flowing among the projecting pins.

BRIEF DESCRIPTION OF THE DRAWINGS

The above and/or other aspects will become apparent and more readily appreciated from the following description of exemplary embodiments, taken in conjunction with the accompanying drawings, in which.

DETAILED DESCRIPTION OF EXEMPLARY EMBODIMENTS

Below, one or more exemplary embodiments will be described in detail with reference to accompanying drawings.

Figure 3:
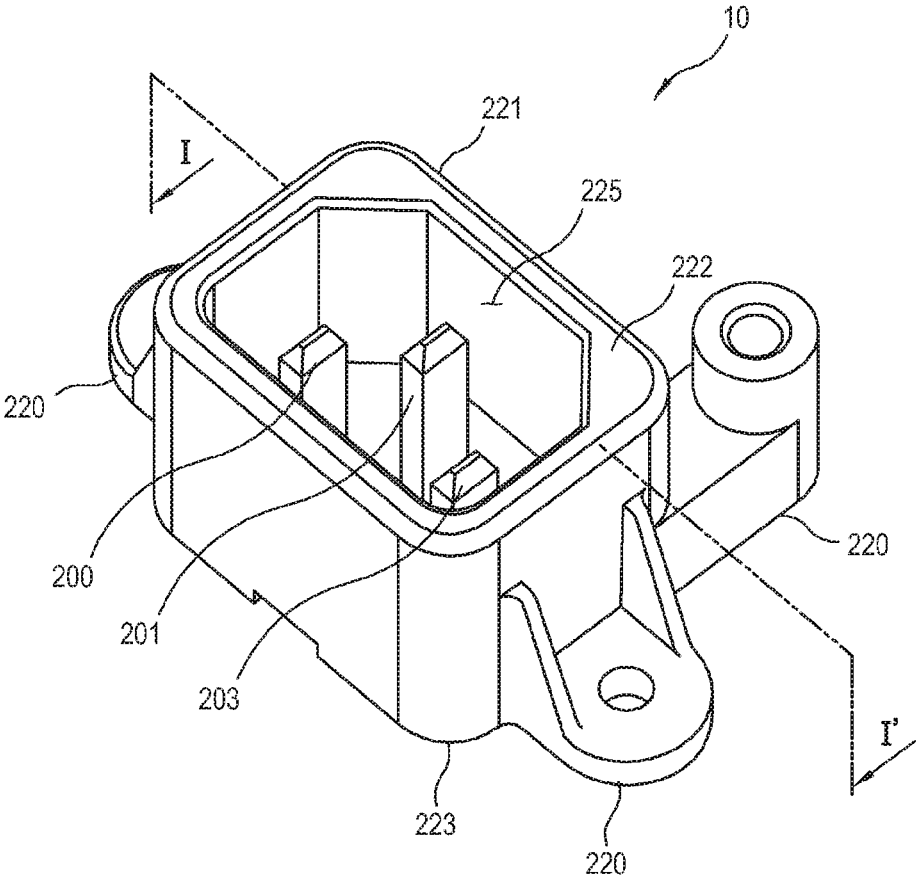
FIG. 3 is a perspective view of a power inlet socket according to an exemplary embodiment.
Figure 4:
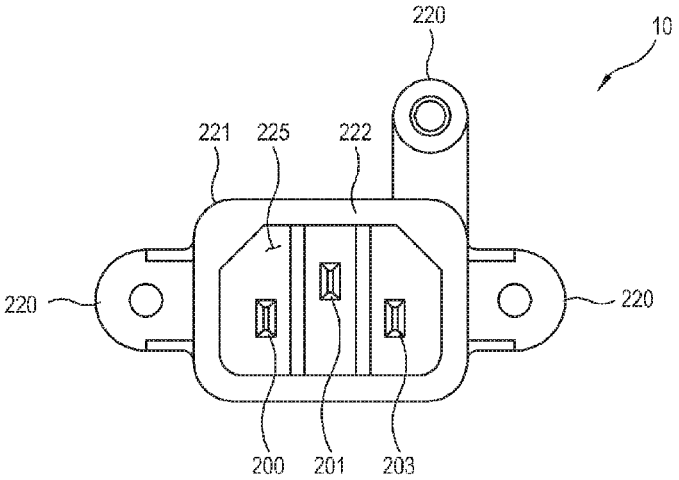
FIG. 4 is a front view of a power inlet socket according to an exemplary embodiment.
Figure 5:
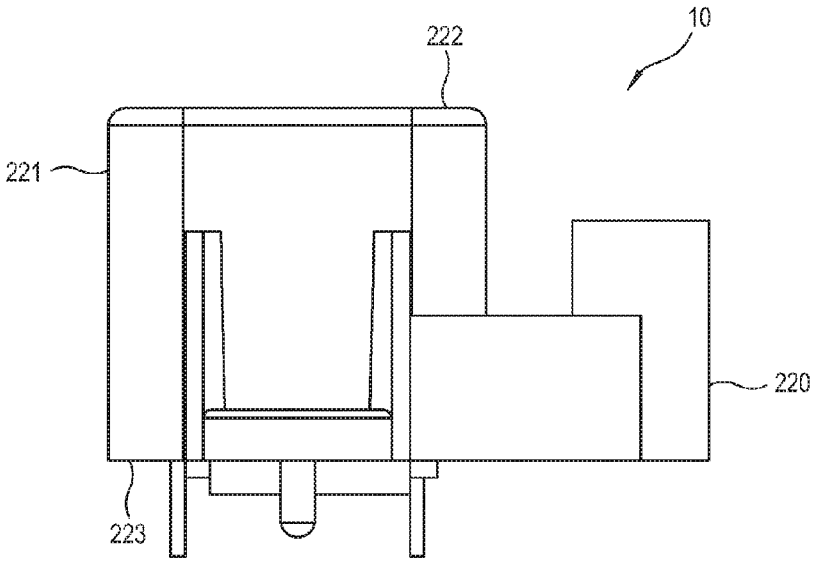
FIG. 5 is a lateral view of a power inlet socket according to an exemplary embodiment.

FIG. 3 is a perspective view of a power inlet socket according to an exemplary embodiment. FIG. 4 is a front view of a power inlet socket according to an exemplary embodiment. FIG. 5 is a lateral view of a power inlet socket according to an exemplary embodiment. A power inlet socket 10 includes a socket body 221 including power plug connectors 222 and 225 to which an external power plug 2 is connected, and power delivering member connectors 220 and 223 connected to a power delivering member 20 delivering power to a substrate of a power supply of the electronic device 1 or to the electronic device 1, and three terminal pins 200, 210, 201, 211, 203 and 213 including projecting pins 200, 201 and 203 extending in parallel with one another from the power plug connectors 222 and 225 and connection terminals 210, 211 and 213 exposed through the power delivering member connectors 220 and 223, respectively. The three terminal pins 200, 210, 201, 211, 203 and 213 are lives 200 and 210, neutrals 203 and 213 and grounds 201 and 211.

The socket body 221 consists of an insulating material, and the power plug connectors 222 and 225 include a top portion 222 of the socket body 221 and a cavity 225 accommodating a power plug 2. The top portion 222 of the socket body 221 faces an external power plug 2 and the cavity 225 accommodates the power plug 2. The projecting pins 200, 201 and 203 of the three terminal pins 200, 210, 201, 211, 203 and 213 which are in parallel with one another and connect a terminal of the power plug 2 are provided in the cavity 225.

The power delivering member connectors 220 and 223 include a bottom portion 223 of the socket body 221, and a coupling portion 220 coupled to the power delivering member 20. The bottom portion 223 faces a circuit substrate of a power supply of the electronic device 1 or the power delivering member 20, and the coupling portion 220 is configured to couple the power inlet socket 10 to the power delivering member 20 of the electronic device 1.

The three terminal pins 200, 210, 201, 211, 203 and 213 are configured to receive external power that is input through the power plug 2. The three terminal pins 200, 210, 201, 211, 203 and 213 include the projecting pins 200, 201 and 203 extending in parallel with one another, and the connection terminals 210, 211 and 213 exposed to the bottom portion 223 of the socket body 221 and electrically connected to a circuit substrate or to the power delivering member 20 and providing received power to the power delivering member 20. The three terminal pins 200, 210, 201, 211, 203 and 213 may include lives 200 and 210 delivering AC power, neutrals 203 and 213 and grounds 201 and 211 connected to the ground.

Figure 6:
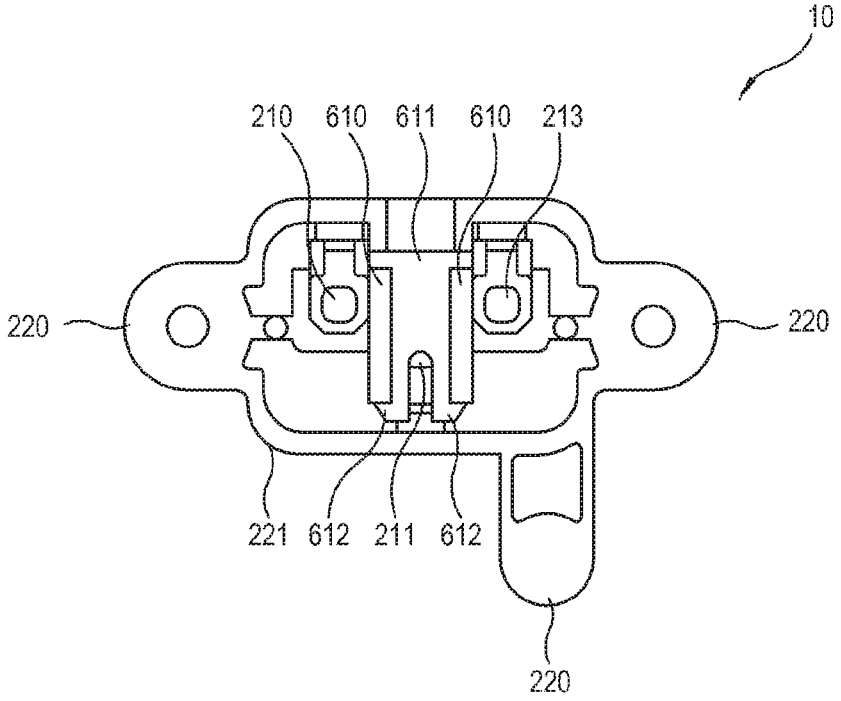
FIG. 6 is a rear view of a power inlet socket according to an exemplary embodiment.

FIG. 6 is a rear view of the power inlet socket 10 according to an exemplary embodiment. Referring to FIG. 6, the three connection terminals 210, 211 and 213 which are provided in the power delivering member connectors 220 and 223 are exposed through the bottom portion 223 of the socket body 221. Each of the connection terminals 210, 211 and 213 may include an additional connector to be electrically connected to the power delivering member 20.

According to an exemplary embodiment, in the bottom portion 223 of the power delivering member connectors 220 and 223 of the power inlet socket 10, insulating barriers 610 and 611 are provided to further widen an insulating distance among the connection terminals 210, 211 and 213 to thereby cut off an electric current flowing among the connection terminal 211 of the grounds 201 and 211 and the connection terminals 210 and 213 of the lives 200 and 210 and neutrals 203 and 213. A plurality of conductors such as wires or terminals is distant from one another to prevent a short from occurring due to discharge or electric current. The distance between the two conductors is called an insulating distance. The insulating distance is determined by specifications, but is weak to an instantaneous high voltage such as lightning although the insulating is maintained. Therefore, in order to practically widen the insulating distance by making a path to reach the surface among the connection terminals 210, 211 and 213 even if the distance among the connection terminals 210, 211 and 213 is not physically more distant, the insulating barriers 610 and 611 according to an exemplary embodiment are provided.

The insulating barriers 610 and 611 are provided to widen the insulating distance among the connection terminals 210, 211 and 213. More specifically, the insulating barriers 610 and 611 are provided to block a path among the connection terminals 210, 211 and 213 or to cover the connection terminals 210, 211 and 213 so that an instantaneous high current caused by lightning, etc. is transmitted through a surface reaching path formed along a surface of the power delivering member connectors 220 and 223 which is longer than a straight reaching path among the connection terminals 210, 211 and 213. As the insulating barriers 610 and 611 are provided among the connection terminals 210, 211 and 213, a high current caused by a high voltage applied from the outside bypasses, rather than moves straightly to, the connection terminals 210, 211 and 213. The current bypasses along the path, and exits to the outside instead of entering the electronic device 1.

Figure 1:
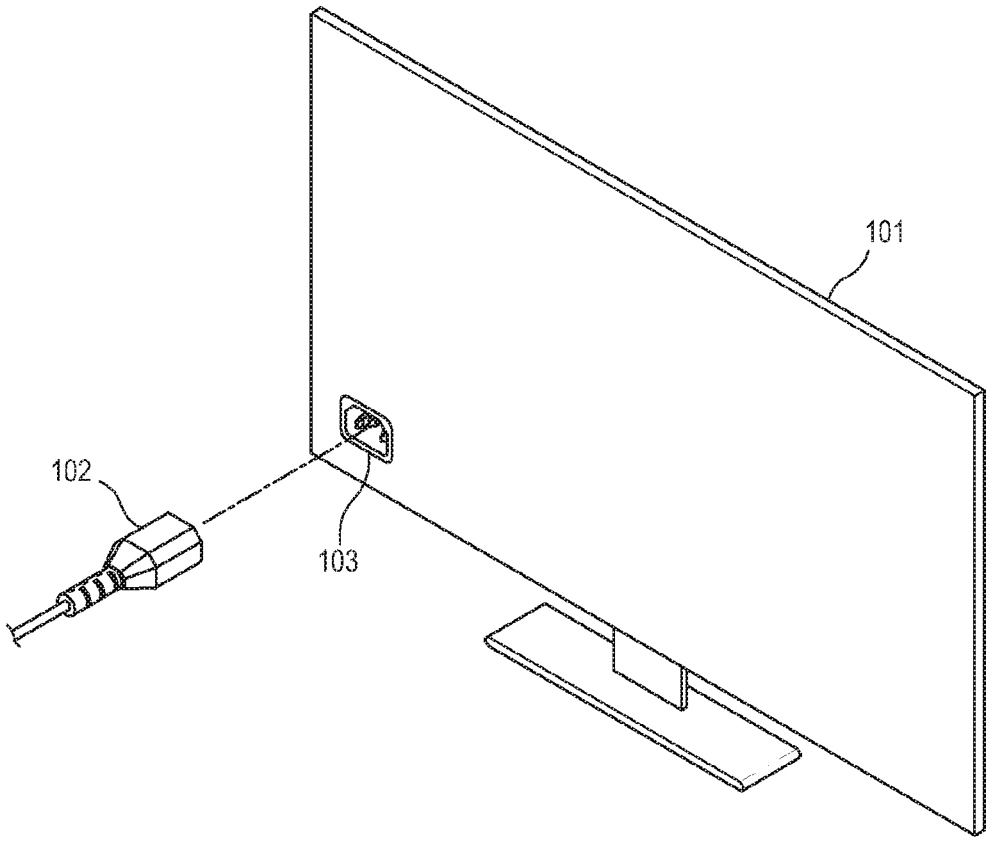
FIG. 1 RELATED ART
FIG. 1 illustrates an electronic device, a power inlet socket provided in the electronic device and an external power plug for supplying power.
Figure 2:
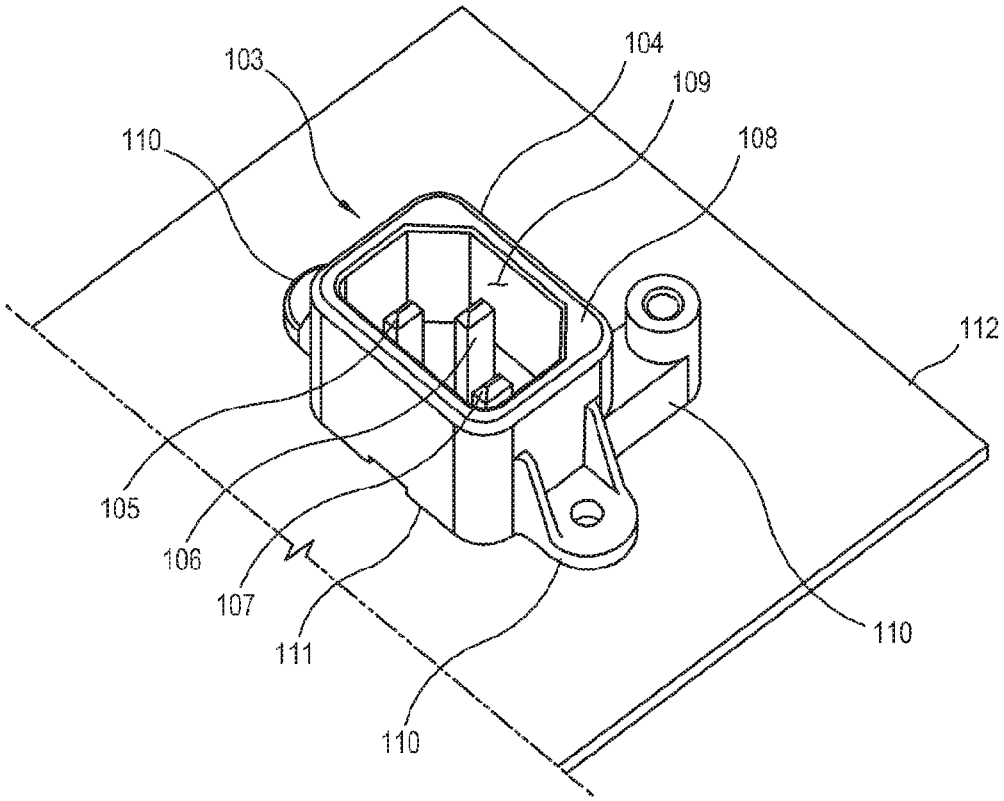
FIG. 2 RELATED ART
FIG. 2 illustrates a conventional power inlet socket and a power delivering member for supplying power to an electronic device.
Figure 2:
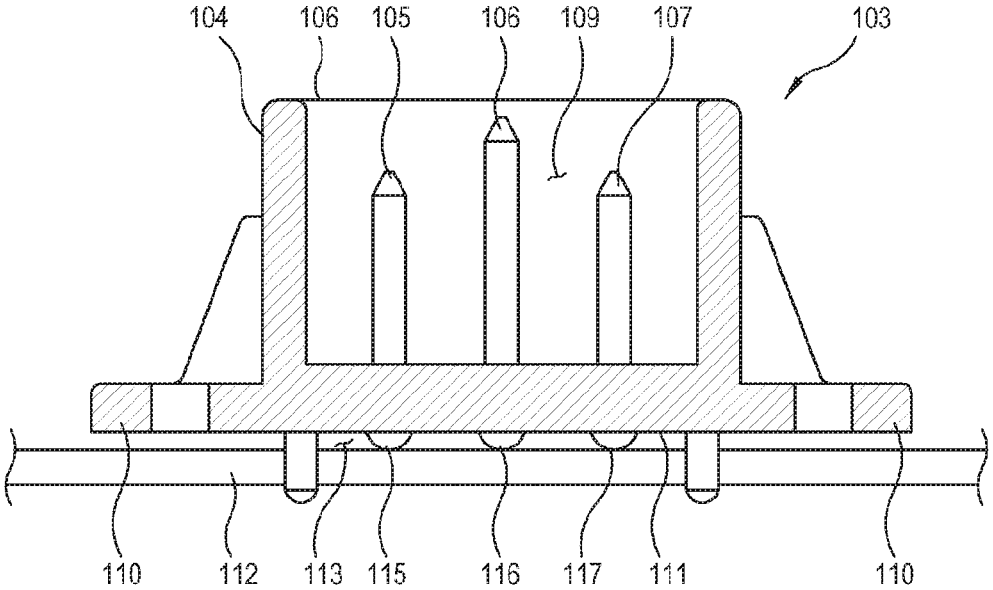
FIG. 2 RELATED ART

If a high voltage is abruptly applied due to lightning, etc. between the connection terminals 210 and 211 of the lives 200 and 210 and grounds 201 and 211 or between the connection terminals 213 and 211 of the neutrals 203 and 213 and the grounds 201 and 211 and thus an electric current flows in the connection terminals 210, 211 and 213 through the space 21 (see FIG. 2) between the power delivering member connectors 220 and 223 of the power delivering member 20 and the socket body 221, unexpected high current may be introduced to the electronic device 1 through the power delivering member 20, and may cause great damage to the electronic device 1. If the surface reaching distance among the connection terminals 210, 211 and 213 is wide, the current bypasses along the path and thus a high voltage may not easily applied to the connection terminals 210, 211 and 213. As an example, if a surface reaching distance among the connection terminals 210, 211 and 213 is wide by 1 mm each, a voltage of 1.5 kV each is insulated.

The insulating barriers 610 and 611 may include a threshold 610 standing among the grounds 201, 211, the lives 200 and 210 and the neutrals 203 and 213, and a top cover 611 coupled to the threshold 610 and covering the connection terminal 211 of the grounds 201 and 211. A guide groove may be provided in the threshold 610, and the top cover 611 may be inserted into and fixed to the threshold 610 along the guide groove. A holder 612 may be provided in an end portion of the top cover 611 to be fixed to the threshold 611.

The insulating barriers 610 and 611 are provided in a space 21 (see FIG. 2) between the power delivering member connectors 220 and 223 and the power delivering member 20 of the electronic device 1, and block a straight reaching path between top portions of a pair of connection terminals to thereby make a surface reaching path to be more distant than the straight reaching path.

According to an exemplary embodiment, the insulating barriers 610 and 611 include the threshold 610 provided in the power delivering member connectors 220 and 223 and the top cover 611 inserted into and fixed to the guide groove of the threshold 610, but the spirit of the present inventive concept is not limited thereto, and may be achieved in various other forms according to one or more exemplary embodiments.

Figure 7:
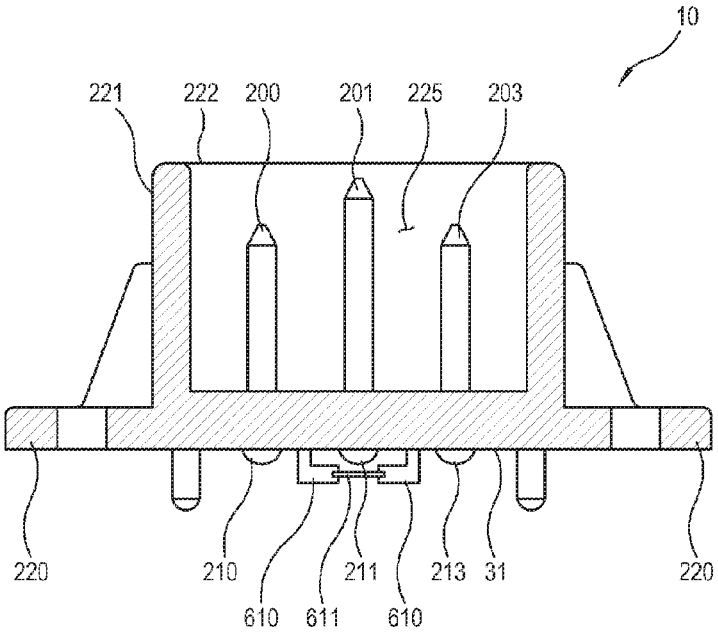
FIG. 7 is a sectional view of a power inlet socket in FIG. 3 taken along line I-I' according to an exemplary embodiment.

FIG. 7 is a sectional view taken along line I-I' in FIG. 3. Referring to FIG. 7, the three terminal pins 200, 210, 201, 211, 203 and 213 include the projecting pins 200, 201 and 203 which pass through the socket body 221 and are connected to terminals of the power plug 2 expending in parallel with one another in the cavity 225 of the power plug connectors 222 and 225. In the power delivering member connectors 220 and 223, the insulating barriers 610 and 611 are provided to cut off an electric current from flowing among the connection terminals 210, 211 and 213 exposed to the bottom portion 223 of the socket body 221.

Figure 8:
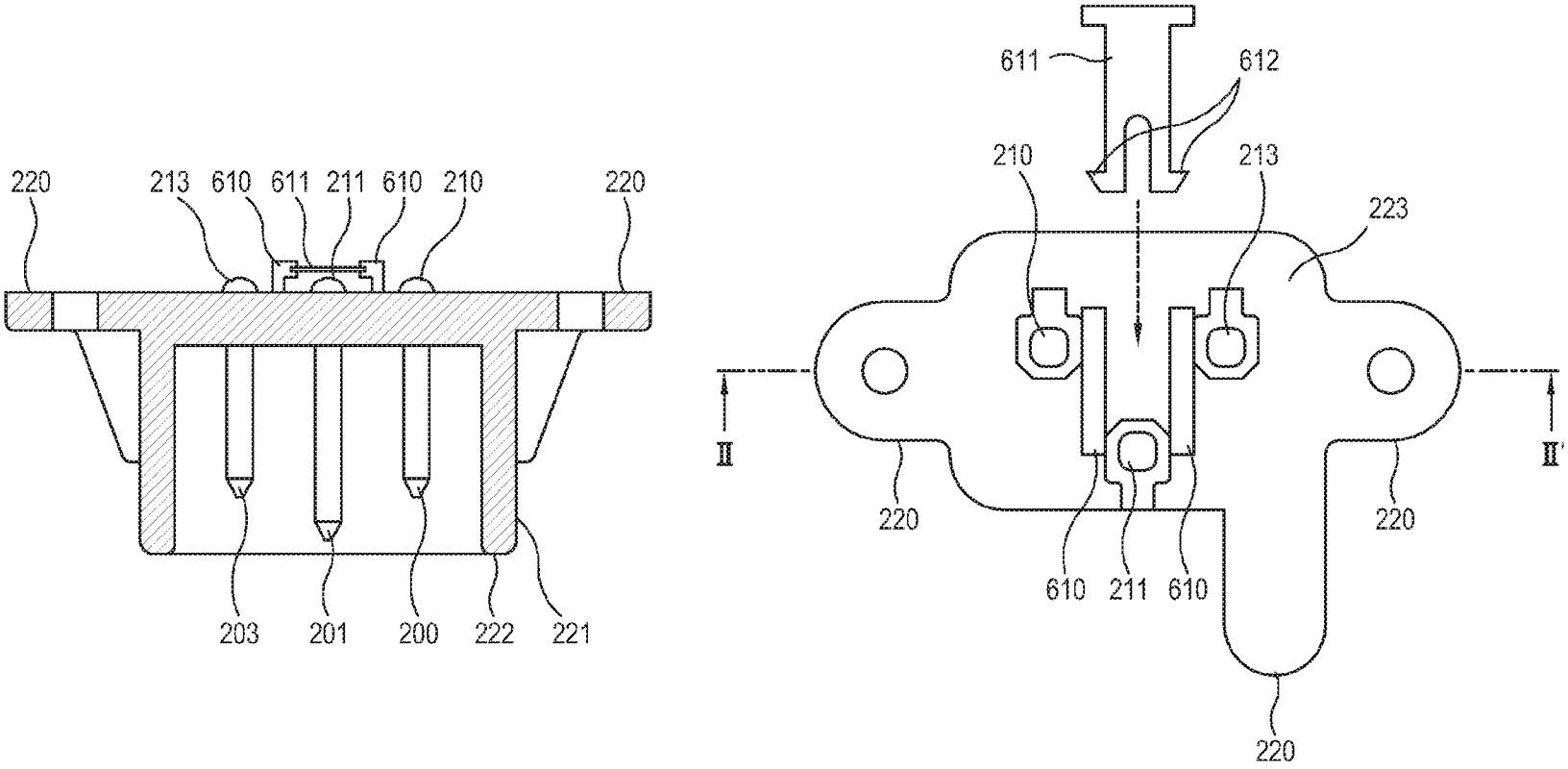
FIG. 8 is a rear view of a power inlet socket in which an insulating barrier is provided in a power delivering member connector and a sectional view of the power inlet socket taken along line II-II' according to an exemplary embodiment.
Figure 9:
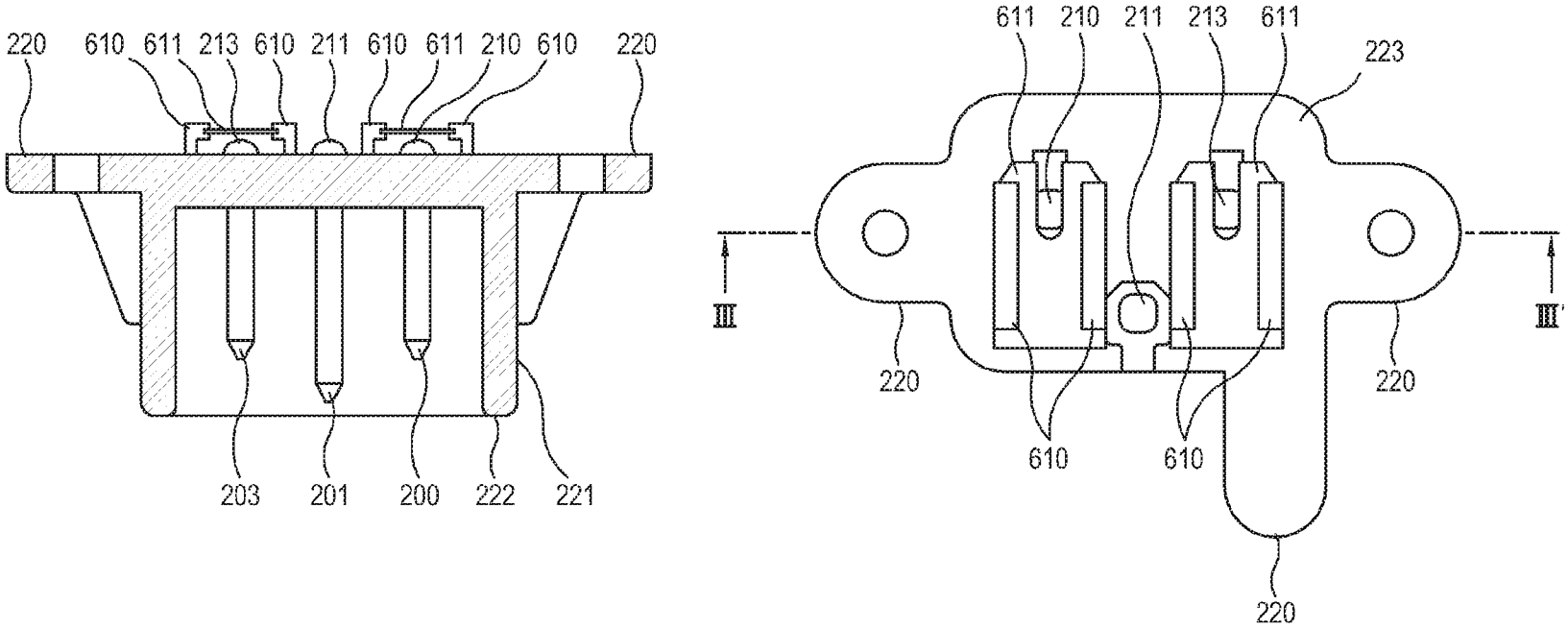
FIG. 9 is a rear view of a power inlet socket in which an insulating barrier is provided in a power delivering member connector and a sectional view of the power inlet socket taken along line III-III' according to an exemplary embodiment.

FIGS. 8 and 9 are a rear view of the power inlet socket in which the insulating barriers 610 and 611 are provided in the bottom portion of the socket body and sectional views of the power inlet socket taken along lines II-II' and III-III'. The power delivering member connectors 220 and 223 may further include the insulating barriers 610 and 611 to cut off an electric current flowing among the connection terminals 210, 211 and 213 exposed to the bottom portion 223 of the socket body 221. According to an exemplary embodiment, the insulating barriers 610 and 611 may be formed as a cover covering at least one of the connection terminals 210, 211 and 213 of the power delivering member connectors 220 and 223. The insulating barriers 610 and 611 include the threshold 610 having a guide groove therein, and the top cover 611 inserted into and fixed to the guide groove of the threshold 610.

Referring to FIG. 8, the insulating barriers 610 and 611 according to an exemplary embodiment are configured to partly cover the connection terminal 211 of the grounds 201 and 211. The insulating barriers 610 and 611 include a pair of thresholds 610 standing with respect to the power delivering member connectors 220 and 223 among the connection terminals 210, 211 and 213, and the top cover 611 covering the connection terminal 211 of the grounds 201 and 211. The guide groove may be provided in the threshold 610, and the top cover 611 may be inserted into and fixed to the threshold 610 along the guide groove. The top cover 611 may further include a holder 612 which projects to be held to and coupled to the threshold 610. As the connection terminal 211 of the grounds 201 and 211 is partly covered by the insulating barriers 610 and 611, the surface reaching distance between the connection terminals 210 and 211 of the lives 200 and 210 and the grounds 201 and 211 and between the connection terminals 213 and 211 of the neutrals 203 and 213 and the grounds 201 and 211 is distant.

Referring to FIG. 9, insulating barriers 610 and 611 according to another exemplary embodiment are configured to cover a connection terminal 210 of lives 200 and 210 and a connection terminal 213 of neutrals 203 and 213. The insulating barriers 610 and 611 include four thresholds 610 provided in the vicinity of the connection terminals 210 and 213 of the lives 200 and 210 and the neutrals 203 and 213 and a top cover 611 inserted into and fixed to the thresholds 610 and covering the connection terminals 210, 211 and 213.

The insulating barriers 610 and 611 are provided between the connection terminals 210 and 211 of the lives 200 and 210 and the grounds 201 and 211 and between the connection terminals 213 and 211 of the neutrals 203 and 213 and the grounds 201 and 211 to widen the insulating distance. As shown in FIG. 8, the insulating barriers 610 and 611 may cover the connection terminal 211 of the grounds 201 and 211, but cover the connection terminals 210 and 213 of the lives 200 and 210 and the neutrals 203 and 213 to thereby widen the insulating distance.

Figure 10:
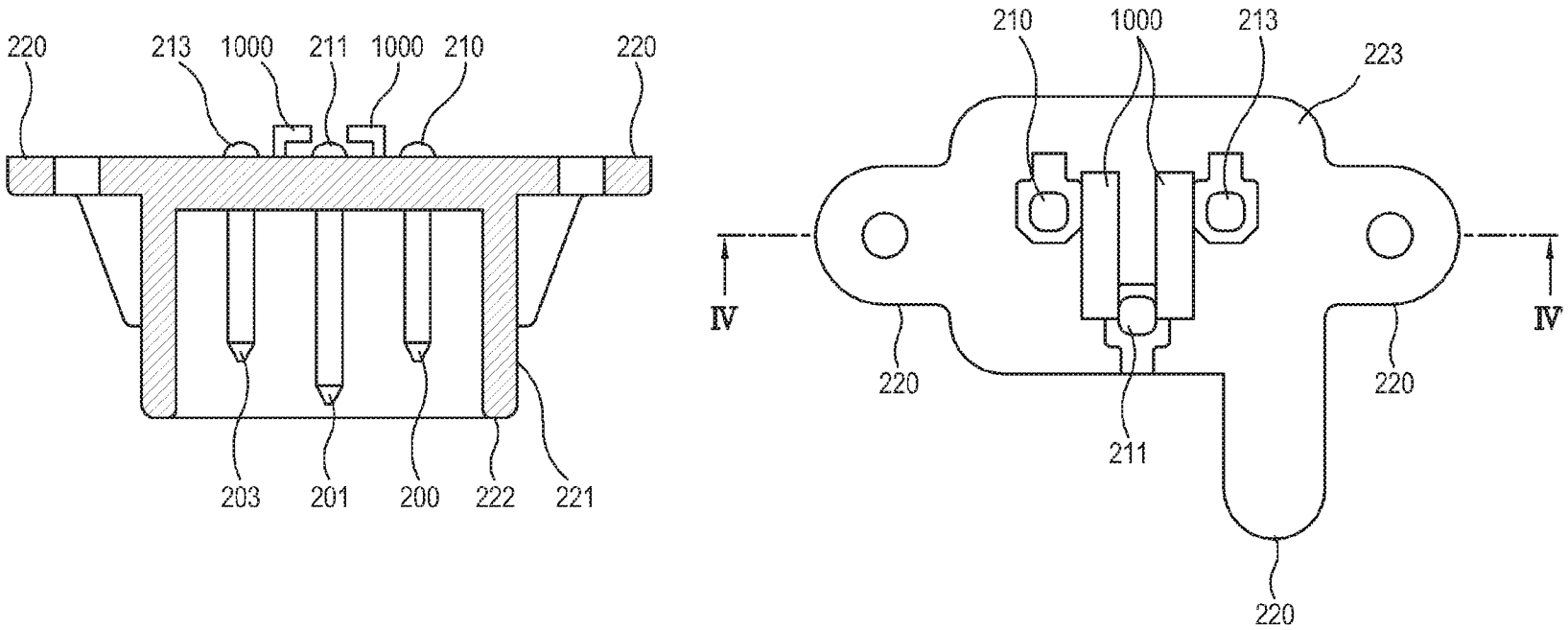
FIG. 10 is a rear view of a power inlet socket in which an insulating barrier is provided in a power delivering member connector and a sectional view of the power inlet socket taken along line IV-IV' according to an exemplary embodiment.
Figure 11:
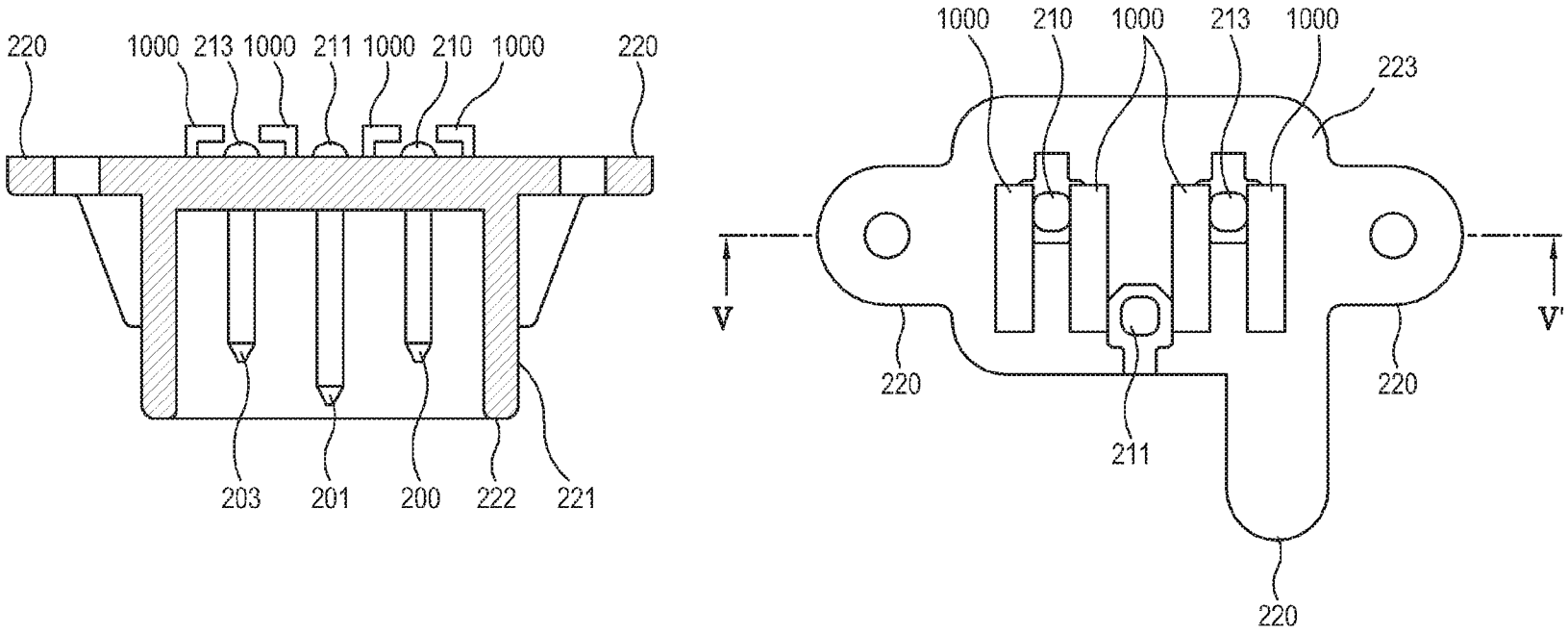
FIG. 11 is a rear view of a power inlet socket in which an insulating barrier is provided in a power delivering member connector and a sectional view of the power inlet socket taken along line V-V' according to an exemplary embodiment.

FIGS. 10 and 11 are a rear view of a power inlet socket in which an insulating barrier is provided in a bottom portion of a socket body and sectional views taken along lines IV-IV' and V-V' according to another exemplary embodiment. Power delivering member connectors 220 and 223 further include an insulating barrier 1000 to cut off an electric current flowing among connection terminals 210, 211 and 213 exposed to a bottom portion 223 of a socket body 221. The insulating barrier 1000 according to an exemplary embodiment may be formed as a cover to cover at least one of the connection terminals 210, 211 and 213, and includes a threshold standing with respect to the power delivering member connectors 220 and 223, and a top cover extending from and integrally formed in the threshold.

Referring to FIG. 10, the insulating barrier 1000 according to an exemplary embodiment is configured to partly cover the connection terminal 211 of the grounds 201 and 211. The insulating barrier 1000 includes a pair of thresholds provided among the connection terminals 210, 211 and 213, and a top cover extending from and integrally formed in the thresholds. The insulating barrier 1000 covers a part of the connection terminal 211 of the grounds 201 and 211 exposed to the power delivering member connectors 220 and 223 to thereby widen a surface reaching distance between the connection terminal 210 of the lives 200 and 210 and the connection terminal 213 of the neutrals 203 and 213.

Referring to FIG. 11, an insulating barrier 1000 according to another exemplary embodiment is configured to cover a connection terminal 210 of lives 200 and 210 and a connection terminal 213 of neutrals 203 and 213. The insulating barrier 1000 includes four thresholds provided in the vicinity of the connection terminals 210 and 213 of the lives 200 and 210 and the neutrals 213, and a cover extending from and integrally formed in the thresholds.

The insulating barrier 1000 is provided between the connection terminals 210 and 211 of the lives 200 and 210 and the grounds 201 and 211 and between the connection terminals 213 and 211 of the neutrals 203 and 213 and the grounds 201 and 211 to widen the insulating distance. As shown in FIG. 10, the insulating barrier 1000 may cover the connection terminal 211 of the grounds 201 and 211, but covers the connection terminals 210 and 213 of the lives 200 and 210 and the neutrals 203 and 213 to thereby widen the insulating distance.

Figure 12:
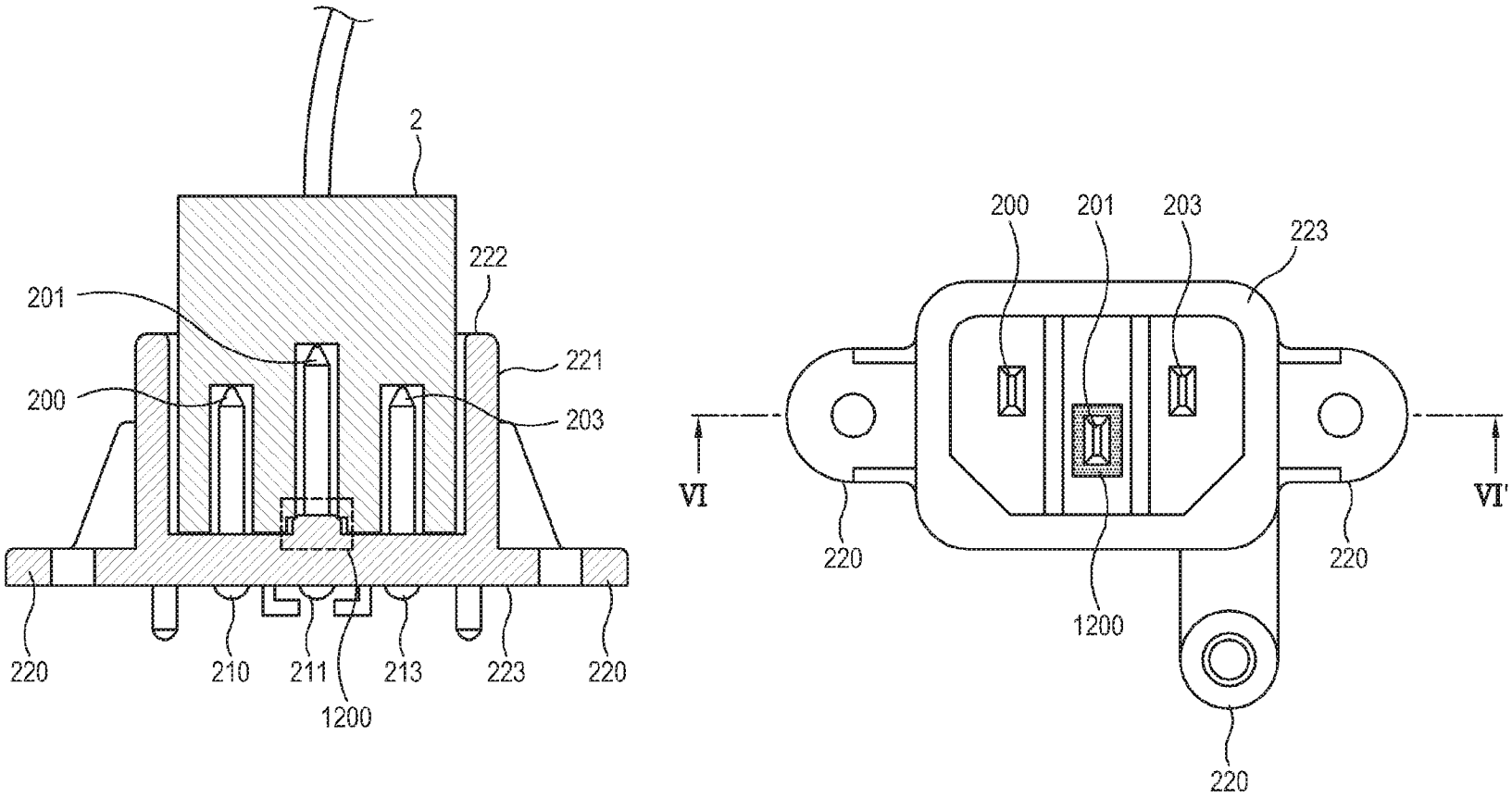
FIG. 12 is a front view of a power inlet socket in which a projection is provided in a power plug connector and a sectional view of the power inlet socket taken along line VI-VI' according to an exemplary embodiment.
Figure 13:
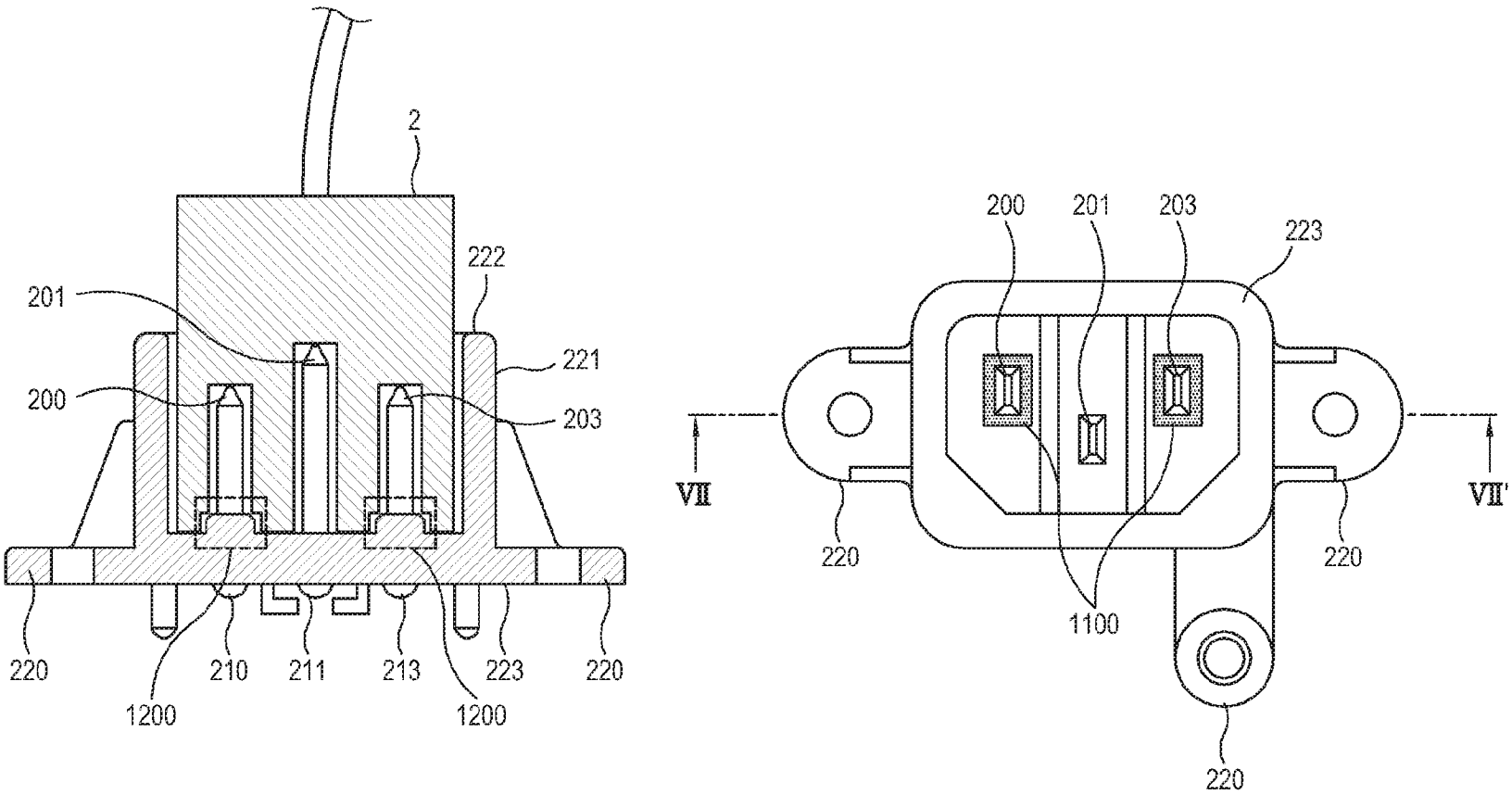
FIG. 13 is a front view of a power inlet socket in which an insulating barrier is provided in a power plug connector and a sectional view of the power inlet socket taken along line VII-VII' according to an exemplary embodiment.

FIGS. 12 and 13 are a front view of a power inlet socket 10 in which an insulating barrier is provided in a cavity 225 of power plug connectors 222 and 225 and sectional views taken along lines VI-VI' and VII-VII' according to another exemplary embodiment. The power plug connectors 222 and 225 include a top portion 224 of the socket body 221 and a cavity 225 to which a power plug 2 is coupled. The power plug connectors 222 and 225 may further include a projection 1200 provided in the cavity 225 to cut off an electric current flowing among projecting pins 200, 201 and 203 of three terminal pins 200, 210, 201, 211, 203 and 213. The projection 1200 according to an exemplary embodiment projects from the power plug connectors 222 and 225 and covers a part of at least one of the projecting pins 200, 201 and 203 to thereby cut off an electric current flowing among the projecting pins 200, 201 and 203 when the power plug 2 is connected.

The external power plug 2 includes an insulating material, and covers most of the projecting pins 200, 201 and 203 when coupled to the power plug connectors 225 and 225. However, even if the external power plug 2 is fully adhered to and coupled to the power plug connectors 222 and 225, there may be a small space between the power plug 2 and the cavity 225, and a high voltage due to lightning, etc. may be applied to at least a pair of projecting pins 200, 201 and 203 through the space between the power plug 2 and the cavity 225. The projection 1200 according to an exemplary embodiment is configured to insulate the three terminal pins 200, 210, 201, 211, 203 and 213.

Referring to FIG. 12, the projection 1200 projects from a bottom surface of the cavity 225 and covers a part of the projecting pin 201 of the grounds 201 and 211. If the power plug 2 is coupled, a bottom portion of the projecting pins 200 and 203 of the lives 200 and 210 and the neutrals 203 and 213 is exposed to the small space, but the projecting pin 201 of the grounds 201 and 211 is adhered to the power plug 2 by the projection 1200 and an electric current with the projecting pins 200 and 203 of the lives 200 and 210 and the neutrals 203 and 213 is cut off.

Referring to FIG. 13, the projection 1200 projects from a bottom surface of the cavity 225 to cover a part of the projecting pins 200 and 203 of the lives 200 and 210 and the neutrals 203 and 213. The projection 1200 is provided to cut off an electric current between the projecting pins 200 and 201 of the lives 200 and 210 and the grounds 201 and 211 and between the projecting pins 203 and 201 of the neutrals 203 and 213 and the grounds 201 and 211. As shown in FIG. 11, the projection 1200 may cover a part of the projecting pin 201 of the grounds 201 and 211, but covers a part of the projecting pins 200 and 203 of the lives 200 and 210 and the neutrals 203 and 213 to thereby providing an insulating effect.

Figure 14:
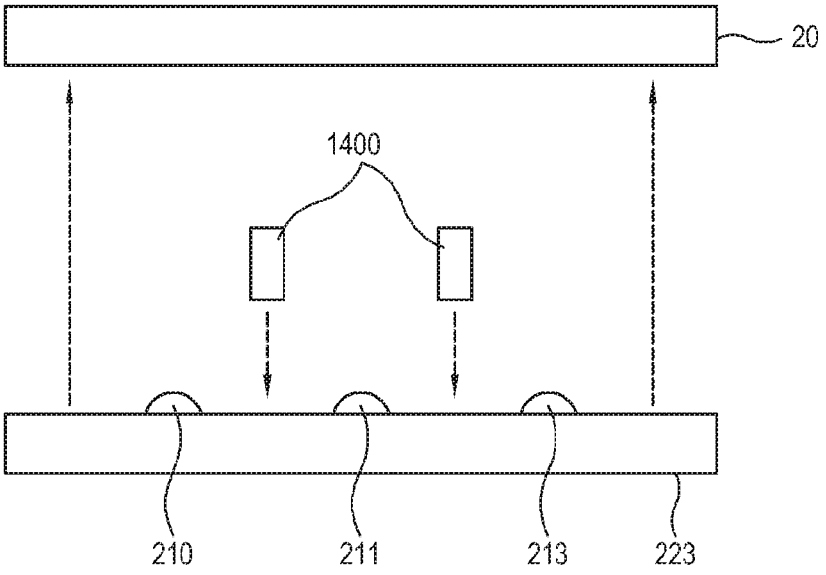
FIG. 14 is a schematic view of a power delivering member connector in which a threshold coupled and fixed thereto is provided among connection terminals according to an exemplary embodiment.

FIG. 14 briefly illustrates power delivering member connectors in which a threshold coupled and fixed thereto is provided according to an exemplary embodiment. Referring to FIG. 14, a threshold 1400 according to an exemplary embodiment stands with respect to the power delivering member connectors 220 and 223 among connection terminals 210, 211 and 213. The pair of thresholds 1400 may be integrally formed in a socket body 221, but may be otherwise inserted into and fixed to the power delivering member connector 222. The pair of thresholds 1400 are coupled to a vicinity of the connection terminal 211 of the grounds 201 and 211, but as described above, may be coupled to a vicinity of the connection terminals 210 and 213 of the live 200 and 210 and the neutral 203 and 213 to cut off an electric current flowing among the connection terminals 210, 211 and 213.

Figure 15:
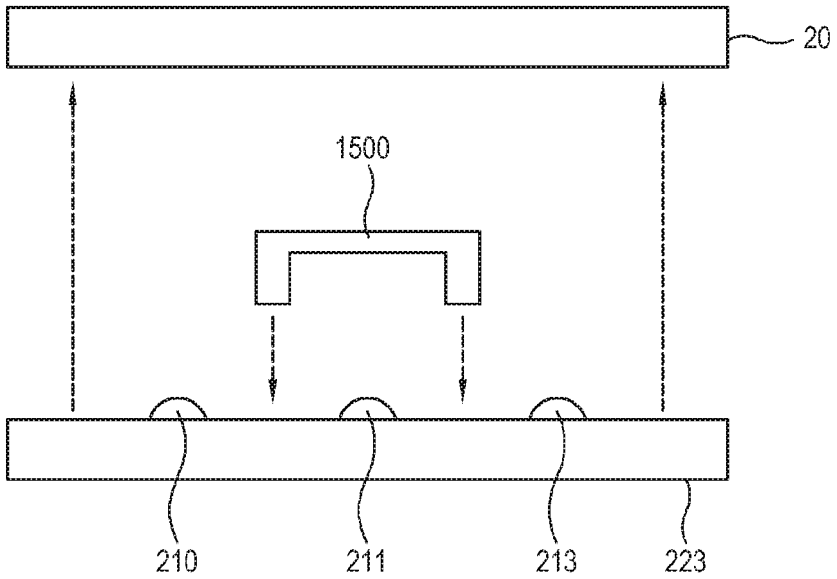
FIG. 15 is a schematic view of a power delivering member connector in which a cover coupled and fixed thereto is provided according to an exemplary embodiment.

FIG. 15 briefly illustrates power delivering member connectors in which an insulating barrier including a cover coupled and fixed thereto is provided. Referring to FIG. 15, a cover 1500 is provided to cover a connection terminal 211 of grounds 201 and 211 exposed to the power delivering member connectors 220 and 223. The cover 1500 may be integrally formed in a socket body 221, and may be inserted into and fixed to the power delivering member connector 222. The cover 1500 according to an exemplary embodiment is coupled to cover the connection terminal 211 of the grounds 201 and 211, but as described above, a pair of thresholds 1600 may cover the connection terminals 210 and 213 of the lives 200 and 210 and the neutrals 203 and 213 and are coupled to the power delivering member connectors and cut off an electric current flowing among the connection terminals 210, 211 and 213.

Figure 16:
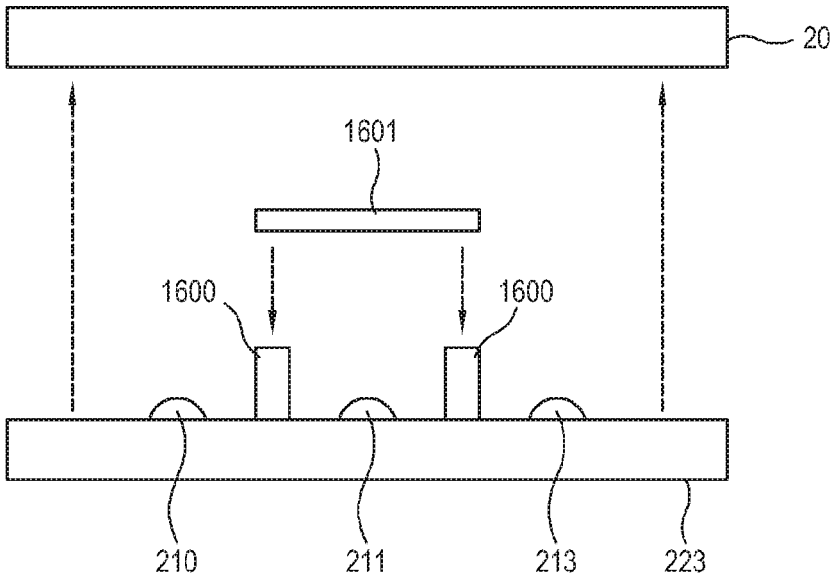
FIG. 16 is a schematic view of the power delivering member connector in which an insulating barrier including a threshold and a top cover fixed and coupled to the threshold is provided according to an exemplary embodiment.

FIG. 16 briefly illustrates power delivering member connectors in which insulating barriers including a threshold and a top cover fixed and coupled to the threshold is provided. Referring to FIG. 16, the insulating barriers 1600 and 1601 include a pair of thresholds 1600 standing with respect to the power delivering member connectors 220 and 223, and a top cover 1601 coupled and fixed to the pair of thresholds 1600 and covering a connection terminal 211 of the grounds 201 and 211. The pair of thresholds 1600 according to an exemplary embodiment are integrally formed in the power delivering member connectors 220 and 223 and only the top cover 1601 is coupled and fixed to the thresholds 1600, but the pair of thresholds 1600 may be also coupled and fixed to the power delivering member connectors 220 and 223. The top cover 1601 may be coupled by inserting a screw or other coupling means to a groove of the thresholds 1600.

The insulating barriers which have been described with reference to drawings are not limited to the shapes, forms or coupling methods described above, and may have various forms and shapes to widen the insulating distance to cut off an electric current flowing among the connection terminals 210, 211 and 213 of the three terminal pins 200, 210, 201, 211, 203 and 213 or the projecting pins 200, 201 and 203, and may employ various coupling methods to be provided in the socket body, as will be obvious to the person of ordinary skill in the art.

As described above, as a distance between a pair of AC power input terminals and grounds is additionally secured, an instantaneous high current caused by lightning, etc. is not easily introduced to the electric device.

Although one or more exemplary embodiments have been shown and described, it will be appreciated by those skilled in the art that changes may be made to exemplary embodiments without departing from the principles and spirit of the invention, the scope of which is defined in the appended claims and their equivalents.

What is claimed is:

1. A power inlet socket coupled to a power delivering member of an electronic device to supply power from an external power plug to the electronic device, the power inlet socket comprising:

a socket body comprising a power plug connector connected to the external power plug and a power delivering member connector connected to the power delivering member;

three terminal pins, each terminal pin comprises a projecting pin extending from the power plug connector in parallel with one another to correspond to a terminal of the external power plug and a connection terminal exposed to the power delivering member connector; and an insulating barrier provided between at least a pair of connection terminals of the three terminal pins to cut off an electric current flowing among the connection terminals, wherein the insulating barrier comprises a cover to cover at least one of the connection terminals.

2. A power inlet socket coupled to a power delivering member of an electronic device to supply power from an external power plug to the electronic device, the power inlet socket comprising:

a socket body comprising a power plug connector connected to the external power plug and a power delivering member connector connected to the power delivering member;

three terminal pins, each terminal pin comprises a projecting pin extending from the power plug connector in parallel with one another to correspond to a terminal of the external power plug and a connection terminal exposed to the power delivering member connector;

an insulating barrier provided between at least a pair of connection terminals of the three terminal pins to cut off an electric current flowing among the connection terminals; and a projection that projects from the power plug connector and covers a part of the projecting pins of at least one of the three terminal pins to cut off an electric current flowing among the projecting pins.

3. The power inlet socket according to claim 1, wherein the cover is coupled to the power delivering member connector.

4. The power inlet socket according to claim 1 wherein the cover is integrally formed in the power delivering member connector.

5. The power inlet socket according to claim 1, wherein the cover comprises:

a threshold standing with respect to the power delivering member connector; and a top cover covering the connection terminals.

6. The power inlet socket according to claim 5, wherein the top cover extends from the threshold and is integrally formed in the threshold.

7. The power inlet socket according to claim 5, wherein the top cover is coupled to the threshold.

8. The power inlet socket according to claim 5, wherein the threshold is formed with a guide groove, and the top cover is inserted into the threshold and fixed to the threshold along the guide groove.

9. The power inlet socket according to claim 5, wherein the threshold is coupled to the power delivering member connector.

10. The power inlet socket according to claim 5, wherein the threshold is integrally formed in the power delivering member connector.

11. A power inlet socket coupled to a power delivering member of an electronic device to supply power from an external power plug to the electronic device, the power inlet socket comprising:

a socket body comprising a power plug connector connected to the external power plug and a power delivering member connector connected to the power delivering member;

three terminal pins, each terminal pin comprises a projecting pin extending from the power plug connector in parallel with one another to correspond to a terminal of the external power plug and a connection terminal exposed to the power delivering member connector; and an insulating barrier provided between at least a pair of connection terminals of the three terminal pins to cut off an electric current flowing among the connection terminals, wherein the insulating barrier comprises a threshold that projects from the power delivering member connector by a predetermined height.

12. The power inlet socket according to claim 5, wherein a height of the threshold is higher than a top portion of at least one of the pair of connection terminals.

13. The power inlet socket according to claim 1, wherein the insulating barrier is provided in a space between the power delivering member connector and the power delivering member of the electronic device.

14. The power inlet socket according to claim 13, wherein the insulating barrier is configured to block a straight path between top portions of the pair of connection terminals.

* * * * *